US007033213B2

(12) United States Patent
Dove

(10) Patent No.: US 7,033,213 B2
(45) Date of Patent: Apr. 25, 2006

(54) CONNECTOR FOR SHIELDED CABLE ASSEMBLY

(75) Inventor: Daniel Joseph Dove, Colfax, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/798,741

(22) Filed: Mar. 10, 2004

(65) Prior Publication Data

US 2005/0202724 A1 Sep. 15, 2005

(51) Int. Cl.
*H01R 9/05* (2006.01)

(52) U.S. Cl. ..... 439/578; 174/35; 439/610

(58) Field of Classification Search ..... 439/607, 439/578, 610, 608, 95; 174/35–36
See application file for complete search history.

(56) References Cited

U.S. PATENT DOCUMENTS

| | | | | |
|---|---|---|---|---|
| 2,685,673 | A * | 8/1954 | Avins | 324/754 |
| 3,573,704 | A * | 4/1971 | Tarver | 439/76.1 |
| 3,974,696 | A * | 8/1976 | Fitzmayer | 374/155 |
| 4,370,630 | A * | 1/1983 | Capek et al. | 333/24 C |
| 4,589,398 | A * | 5/1986 | Pate et al. | 123/596 |
| 4,599,483 | A * | 7/1986 | Kuhn et al. | 174/36 |
| 5,439,393 | A * | 8/1995 | Watson | 439/578 |
| 6,686,538 | B1 * | 2/2004 | Yamamoto | 174/36 |
| 2003/0024717 | A1 * | 2/2003 | Knighten et al. | 174/35 R |

* cited by examiner

*Primary Examiner*—Michael C. Zarroli

(57) ABSTRACT

A cable connector assembly for receiving a shielded cable assembly includes a conductive connector shield and an impedance operable to couple the connector shield to a shield of the shielded cable assembly. In an embodiment, the connector shield is positioned such that the connector shield does not directly contact the cable assembly shield when the cable assembly is received by the connector assembly.

8 Claims, 4 Drawing Sheets

CONNECTOR FOR SHIELDED CABLE ASSEMBLY

BACKGROUND

In the Local-Area-Networking (LAN) industry, Unshielded-Twisted-Pair (UTP) cables are predominant. UTP cables are used because the twisting provides high immunity to electromagnetic interference (EMI) and electromagnetic compatibility (EMC). Further, because they are unshielded, UTP cables provide isolation between stations that might have unequal ground potentials and thus prevent ground loops between such stations.

For 10-Gigabit-Ethernet-on-UTP solutions being considered by the IEEE, there is a problem associated with UTP that may limit feasibility and increase cost of the silicon being considered. This problem is typically referred to as Alien-Near-End Crosstalk (ANEXT) which is noise/interference that comes from electrical signals on adjacent UTP cables and typically cannot be eliminated by a transceiver using correlated noise cancellation circuits.

In addition, Near-End Crosstalk (NEXT) caused by adjacent transmitters also causes interference, but is typically less of a problem as associated electrical signals are correlated to a reference source that a transceiver can use to cancel much of the interference.

There are types of shielded cables that would substantially reduce the effects of this interference, but because the shielding is connected to ground at both ends of a cable, these cables may generate ground loops.

A ground loop exists when two pieces of equipment, which are on different power circuits and are referenced to different ground potentials, are connected together with a cable having a shield that connects the equipment shields' grounds together with low DC impedance.

Because of this problem with ground loops, the US LAN industry has traditionally supported UTP. In Europe, where Shielded-Twisted-Pair (STP) cables are more common, extensive management of power grids (to maintain equal ground potential from one location to another) is typically required to suppress ground looping. Europe has also adopted a 100-ohm UTP look-alike cable that contains a light foil shield (FTP) and that utilizes a common RJ-45 connector and is field terminable. However, because it is shielded, the UTP look-alike cable typically has the same problems as STP cables with respect to ground loops.

Referring to FIGS. 1 and 2, a conventional shielded modular plug 10 for terminating a shielded multi-pair communication cable 14 is illustrated. Cable 14 comprises an insulating sheath 16 enclosing a conductive cable shield 15 that, in turn, encloses four pairs of conductors or wires 18, each wire pair or signal pair twisted together (not shown) and forming a respective signal path during use. The construction of plug 10 is well known and generally comprises a dielectric housing 19 having a closed forward free end 22, a cable-receiving rearward end 24, a terminal receiving side 26 and a cable-receiving cavity (not shown) extending longitudinally from the rearward end 24 of the housing 19 to the terminal receiving side 26.

The plug 10 further includes a conductive shield portion 20 that electrically contacts the cable shield 15 when, as seen in FIG. 2, the plug 10 receives the cable 14. Eight parallel slots 28 defined by corresponding fins 29 open on to the terminal-receiving side 26 of housing 19 for receiving flat contact terminals 30. The eight slots 28 are aligned over a planar array of respective longitudinally extending wire-receiving parallel passages (not shown) which communicate with the cable-receiving cavity and which receive the ends of respective cable wires 18. Each flat contact terminal 30 is inserted into and fixed within an associated terminal-receiving slot 28 to terminate a respective wire 18 located in a respective wire-receiving passage.

SUMMARY

According to an embodiment of the present invention, a cable connector assembly for receiving a shielded cable assembly comprises a conductive connector shield and an impedance operable to couple the connector shield to a shield of the shielded cable assembly.

DETAILED DESCRIPTION

Figure 1:
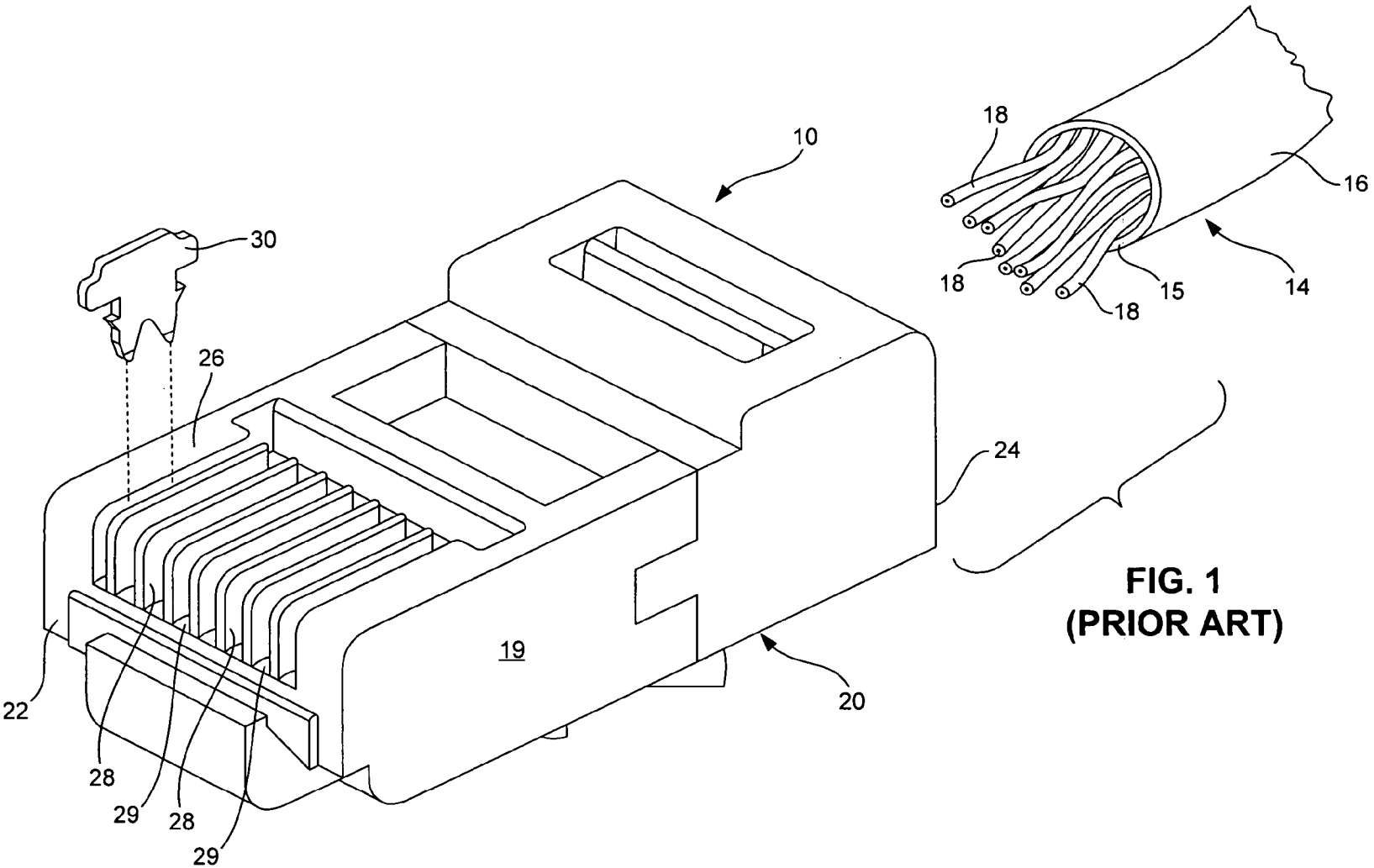
FIG. 1 (PRIOR ART)
FIG. 1 is a perspective view of a conventional modular plug and multi-pair cable prior to termination according to the prior art.
Figure 2:
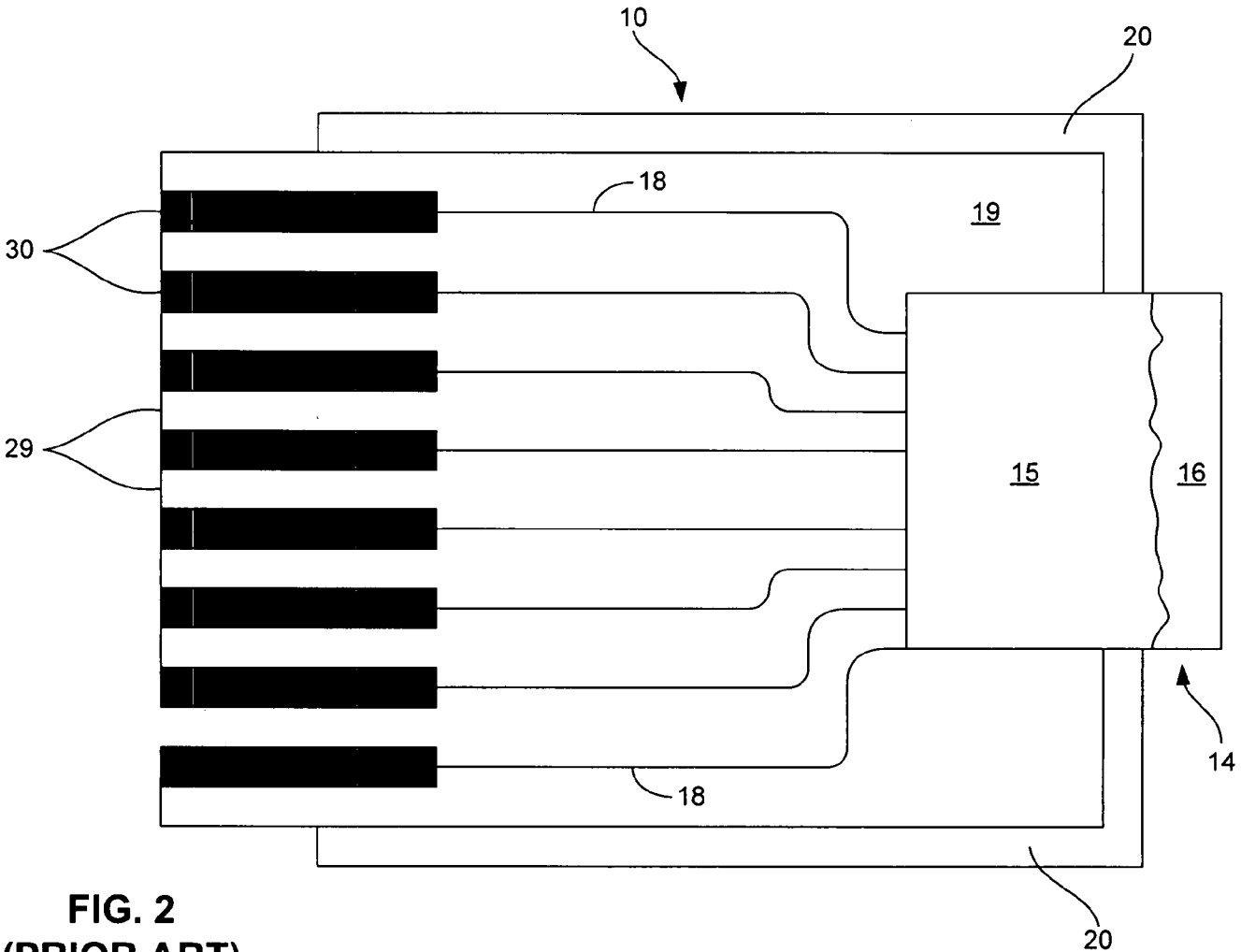
FIG. 2 (PRIOR ART)
FIG. 2 is a top partial-cutaway view of the conventional modular plug and multi-pair cable of FIG. 1 in terminal combination.
Figure 3:
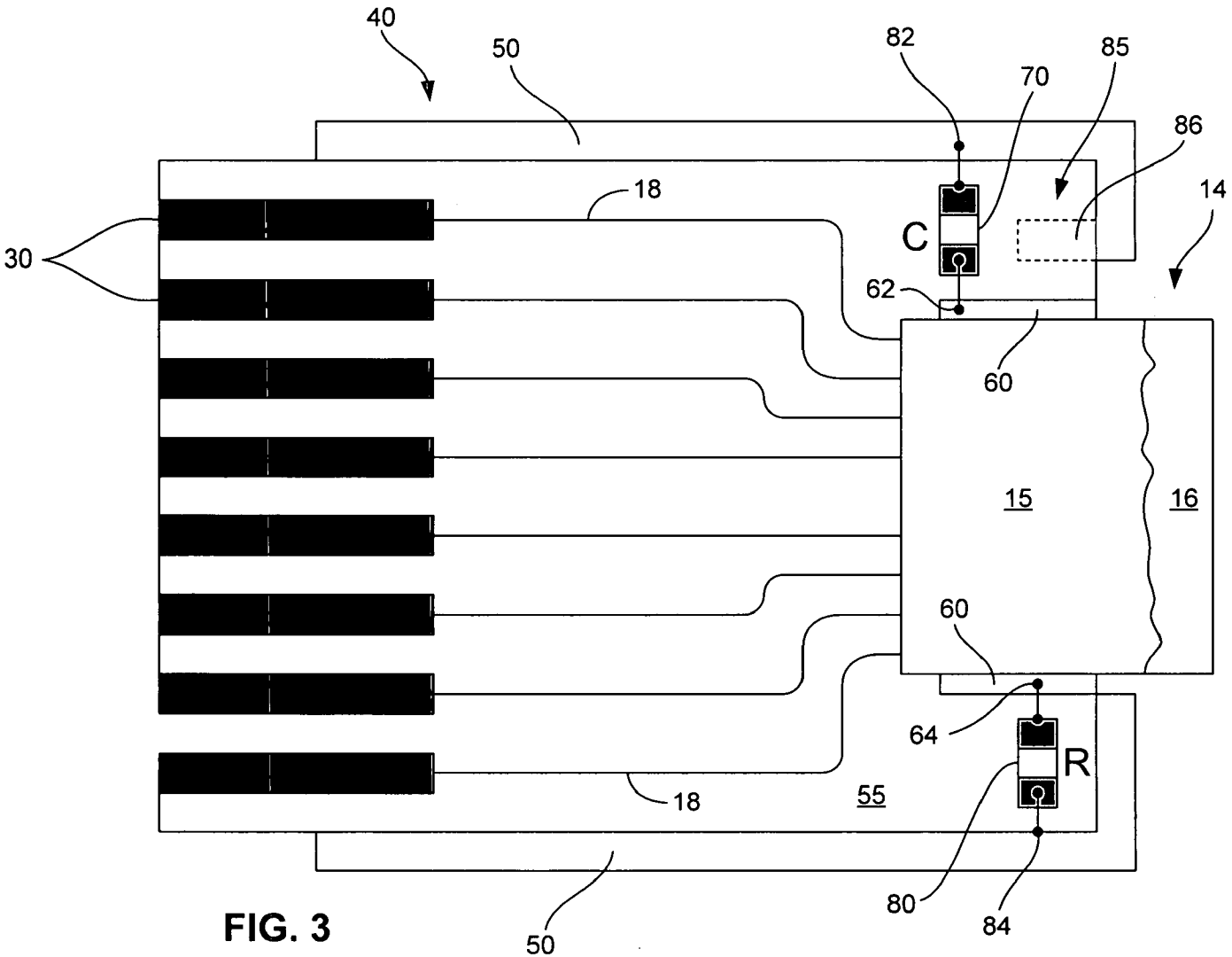
FIG. 3 is a top partial-cutaway view of a modular plug and multi-pair cable in combination according to an embodiment of the present invention.

FIG. 3 illustrates a combination of the shielded multi-pair communication cable 14 of FIG. 2 and a shielded modular plug 40 according to an embodiment of the present invention. As is the case with the prior-art plug-cable combination illustrated in FIGS. 1 and 2, the plug 40 includes contact terminals 30 that terminate respective wires 18 associated with the cable 14. As can be seen in FIG. 3, the plug 40 similarly has disposed thereon a conductive shield portion 50 that is arranged on a dielectric housing 55 such that the conductive shield portion 50 does not contact the cable shield 15 when the cable 14 mates with the plug 40. Disposed within the housing 55 and contacting the cable shield 15 is a conductive element 60 which, in one embodiment, is annular. In alternative embodiments, the conductive element 60 may be of any other shape or configuration suitable for providing an electrical contact with the cable shield. For example, the element 60 may comprise multiple conductive portions.

Attached to the conductive element 60 by respective contact terminals 62 and 64 are a capacitor 70 and a resistor 80. The capacitor 70 and the resistor 80 also contact the shield portion 50 by terminals 82 and 84, respectively. As such, the capacitor 70 and resistor 80 are positioned electrically in parallel between the cable shield 15 and the shield portion 50. In one embodiment, the capacitor 70 and resistor 80 are embedded in the housing 55, the capacitor 70 has a value C of approximately 0.01 μF, and the resistor has a value R of approximately 2 MΩ. The contact terminals 62, 82, 64, 84 are, in one embodiment, made from an elastic conductive material, such as stainless steel, so as to allow relative movement between the shield portion 50 and conductive element 60 without compromising contact with each.

In operation, the resistor 80 enables a relatively small discharge current to flow between the cable shield 15 and ground (via the shield portion 50) when the plug 40 is coupled to an electronic device, such as a computer (not shown). Such a small discharge current prevents static-charge buildup on the cable shield 15. Moreover, by positioning the capacitor 70 between the cable shield 15 and ground, a low-AC impedance connection is created thereby allowing the shield 15 to provide optimal shielding from EMI and EMC. Put another way, the resistor 80 limits to a safe level a DC current that flows between two grounds (at the ends of the cable 14) that are at unequal potentials, but the capacitor 70 grounds the shield 15 for AC signals, particularly for signals that contain AC frequencies that may cause interference.

In an alternative embodiment illustrated in FIG. 3 that excludes the capacitor 70, a capacitance 85 is formed from a combination of the conductive element 60 and a flange 86 (shown in broken lines) of the shield portion 50. That is, the element 60 and flange 86 form respective plates of a capacitor having a capacitance 85. The region between these plates may be filled with air or another dielectric, as is known. The capacitance 85 functions in a manner similar to that described above in connection with the capacitor 70.

Figure 4:
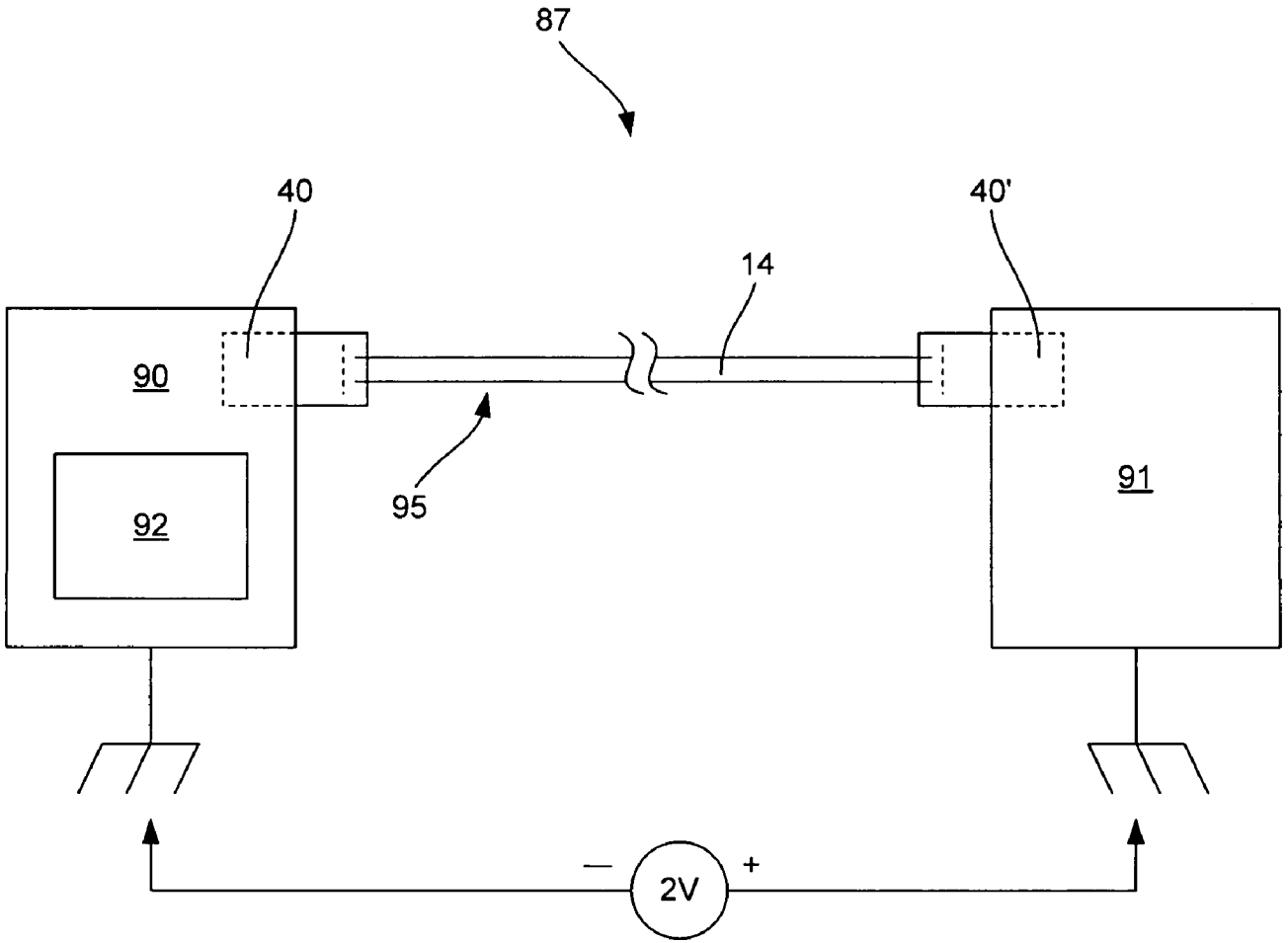
FIG. 4 is a schematic diagram of an electronic system according to an embodiment of the present invention.

FIG. 4 illustrates an electronic system 87 according to an embodiment of the present invention. The electronic system 87 may, for example, be a LAN, or any other system utilizing electrical signals. The electronic system 87 comprises devices 90 and 91 that communicate via a transmission medium 95, which includes the cable 14 and plugs 40 and 40'. At least the device 90 includes a processor 92, and the devices 90 and 91 may be, e.g., personal computers or computer workstations, testing devices, or set-top boxes configured to deliver media to a display device. Alternatively, the device 90 may be an oscilloscope, in which case the device 91 may be a probe assembly as known in the art.

The electronic system 87 further comprises the signal-transmission medium 95 coupled to the devices 90 and 91 as described above. The signal-transmission medium 95 comprises the combination of the cable 14 with, at one end of the cable 14, the plug 40 illustrated in and discussed with reference to FIG. 3, and, at the other end of the cable 14, a plug 40' similar to the plug 40.

By employing the plugs 40 and 40', the electronic system 87 is minimally susceptible to problems associated with ground loops. For example, suppose, as illustrated in FIG. 4, the difference in ground potential between devices 90 and 91 is 2V and the resistance of the cable 14 is negligible. Because the resistor 80 of the plug 40 has, in an embodiment described above, a resistance of 2 MΩ, and the sum of the resistors from plug 40 and 40' is 4 MΩ, the DC current in the cable 14, when joined with both devices 90 and 91, is a mere 0.5 μA.

The preceding discussion is presented to enable a person skilled in the art to make and use the invention. Various modifications to the disclosed embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein.

What is claimed is:

1. A network connection device, comprising:

a shielded cable assembly;

a shielded connector assembly receiving the cable assembly, the connector assembly shield arranged such that there is no direct contact between the connector assembly shield and a shield of the cable assembly, the connector assembly comprising:

a capacitor having first and second terminals, the first capacitor terminal contacting the connector assembly shield, the second capacitor terminal electrically coupled to the cable assembly shield; and a resistor having first and second terminals, the first resistor terminal contacting the connector assembly shield, the second resistor terminal electrically coupled to the cable assembly shield.

2. An electronic system, comprising:

a device; and a signal-transmission medium coupled to the device, the medium comprising:

a shielded cable assembly;

a shielded connector assembly receiving the cable assembly, the connector assembly shield arranged such that there is no direct contact between the connector assembly shield and a shield of the cable assembly, the connector assembly comprising:

a capacitor having first and second capacitor terminals, the first capacitor terminal contacting the connector assembly shield, the second capacitor terminal electrically coupled to the cable assembly shield; and a resistor having first and second resistor terminals, the first resistor terminal contacting the connector assembly shield, the second resistor terminal electrically coupled to the cable assembly shield.

3. The system of claim 2, wherein the device comprises a processor.

4. The system of claim 3, wherein the device is a computer.

5. A method of constructing a cable connector assembly having a body, the connector assembly for coupling to a cable assembly having a cable shield, the method comprising:

electrically coupling a conductive connector shield to the body;

electrically coupling a first terminal of a capacitor to the connector shield, a second terminal of the capacitor operable to be electrically coupled to the cable shield; and electrically coupling a first terminal of a resistor to the connector shield, a second terminal of the resistor operable to be electrically coupled to the cable shield.

6. The method of claim 5, wherein coupling a conductive connector shield to the body comprises positioning the connector shield such that the connector shield does not directly contact the cable shield.

7. A method of constructing a network connection device having a shielded connector assembly receiving a shielded cable assembly, the connector assembly shield arranged such that there is no direct contact between the connector assembly shield and the cable assembly shield, the method comprising:

electrically coupling a first terminal of a capacitor to the connector assembly shield;

electrically coupling a second terminal of the capacitor to the cable assembly shield;

electrically coupling a first terminal of a resistor to the connector assembly shield; and electrically coupling a second terminal of the resistor to the cable assembly shield.

8. A network connection device having a shielded connector assembly receiving a shielded cable assembly, the connector assembly shield arranged such that there is no direct contact between the connector assembly shield and the cable assembly shield, the method comprising:

capacitive means for electrically coupling the connector assembly shield and the cable assembly shield; and resistive means for electrically coupling the connector assembly shield and the cable assembly shield.

* * * * *